US010596833B2

(12) United States Patent
Hashimoto et al.

(10) Patent No.: US 10,596,833 B2
(45) Date of Patent: Mar. 24, 2020

(54) CONVEYING DEVICE, IMAGE FORMING APPARATUS, LIQUID DISCHARGE DEVICE

(71) Applicants: Yasushi Hashimoto, Ibaraki (JP); Satoshi Takanashi, Kanagawa (JP); Genichiro Kawamichi, Kanagawa (JP); Hironobu Murai, Kanagawa (JP); Yuuji Ohmura, Ibaraki (JP)

(72) Inventors: Yasushi Hashimoto, Ibaraki (JP); Satoshi Takanashi, Kanagawa (JP); Genichiro Kawamichi, Kanagawa (JP); Hironobu Murai, Kanagawa (JP); Yuuji Ohmura, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/039,247

(22) Filed: Jul. 18, 2018

(65) Prior Publication Data

US 2019/0047298 A1 Feb. 14, 2019

(30) Foreign Application Priority Data

Aug. 8, 2017 (JP) ..... 2017-153280

(51) Int. Cl.
*B41J 11/00* (2006.01)
*B41J 15/16* (2006.01)

(52) U.S. Cl.
CPC ..... *B41J 11/002* (2013.01); *B41J 15/16* (2013.01); *B41J 15/165* (2013.01)

(58) Field of Classification Search
CPC ..... B41J 11/002; B41J 15/16; B41J 15/165
USPC ..... 347/102
See application file for complete search history.

(56) References Cited

U.S. PATENT DOCUMENTS

| | | | |
|---|---|---|---|
| 2010/0110134 A1 | 5/2010 | Ohmura et al. | |
| 2015/0174921 A1 | 6/2015 | Onodera et al. | |
| 2015/0210091 A1 | 7/2015 | Hoshina et al. | |
| 2015/0346659 A1 | 12/2015 | Nagayama et al. | |
| 2016/0263913 A1* | 9/2016 | Akatsu | B41J 11/0015 |
| 2016/0273832 A1 | 9/2016 | Asada et al. | |

(Continued)

FOREIGN PATENT DOCUMENTS

| | | |
|---|---|---|
| JP | 2009-279869 | 12/2009 |
| JP | 2013-169776 | 9/2013 |

*Primary Examiner* — Huan H Tran
*Assistant Examiner* — Alexander D Shenderov
(74) *Attorney, Agent, or Firm* — Duft & Bornsen, PC

(57) ABSTRACT

A conveying device includes a rotator, a drier, and a conveyance direction changer. The rotator winds a web-shaped recording medium around a predetermined region of an outer peripheral surface of the rotator with one side of the web-shaped recording medium facing outward and conveys the recording medium with rotation. The drier is disposed downstream from the rotator in a direction of conveyance of the recording medium, to dry and convey the recording medium. The conveyance direction changer is disposed on a conveyance path of the recording medium between the rotator and the drier. The conveyance direction changer has an outer peripheral surface that includes an opposed region opposed to the one side of the recording medium. The opposed region has openings to blow gas toward the one side of the recording medium. The rotator and the drier are disposed at positions not overlapping with each other in a plan view.

14 Claims, 12 Drawing Sheets

(56) References Cited

U.S. PATENT DOCUMENTS

2016/0311639 A1* 10/2016 Ishibashi ..... B65H 23/24
2017/0165981 A1 6/2017 Kuwabara et al.

* cited by examiner

CONVEYING DEVICE, IMAGE FORMING APPARATUS, LIQUID DISCHARGE DEVICE

CROSS-REFERENCE TO RELATED APPLICATION

This patent application is based on and claims priority pursuant to 35 U.S.C. § 119(a) to Japanese Patent Application No. 2017-153280, filed on Aug. 8, 2017 in the Japan Patent Office, the entire disclosure of which is hereby incorporated by reference herein.

BACKGROUND

Technical Field

Aspects of the present disclosure relate to a conveying device, an image forming apparatus, and a liquid discharge device.

Related Art

An image forming apparatus is known that forms an image using so-called ultraviolet (UV) ink that is irradiated and cured with ultraviolet rays.

For example, an image forming apparatus includes an inkjet head to discharge UV ink and a UV lamp to cure UV ink. Such an image forming apparatus includes a conveying device including a platen drum that winds and conveys a web-shaped recording medium around an outer peripheral surface of the platen drum.

On the other hand, an image forming apparatus using aqueous ink is known. Since the aqueous ink is difficult to dry, the image forming apparatus using the aqueous ink typically includes a drying section to dry the aqueous ink. To prevent the image from being disturbed, the web-shaped recording medium is conveyed to the drying section so that an image formation surface of the web-shaped recording medium on which the image is formed by the aqueous ink does not contact any component.

SUMMARY

In an aspect of the present disclosure, there is provided a conveying device that includes a rotator, a drier, and a conveyance direction changer. The rotator winds a web-shaped recording medium around a predetermined region of an outer peripheral surface of the rotator with one side of the web-shaped recording medium facing outward and conveys the web-shaped recording medium with rotation of the rotator. The drier is disposed downstream from the rotator in a direction of conveyance of the web-shaped recording medium, to dry and convey the web-shaped recording medium. The conveyance direction changer is disposed on a conveyance path of the web-shaped recording medium between the rotator and the drier. The conveyance direction changer has an outer peripheral surface that includes an opposed region opposed to the one side of the web-shaped recording medium. The opposed region has openings to blow gas toward the one side of the web-shaped recording medium. The rotator and the drier are disposed at positions not overlapping with each other in a plan view.

In another aspect of the present disclosure, there is provided an image forming apparatus that includes the conveying device and an image forming unit opposed to the outer peripheral surface of the rotator, to form an image on the one side of the web-shaped recording medium.

In another aspect of the present disclosure, there is provided a liquid discharge apparatus that includes the conveying device and a liquid discharge unit opposed to the outer peripheral surface of the rotator, to discharge liquid onto the one side of the web-shaped recording medium.

BRIEF DESCRIPTION OF THE SEVERAL VIEWS OF THE DRAWINGS

A more complete appreciation of the disclosure and many of the attendant advantages and features thereof can be readily obtained and understood from the following detailed description with reference to the accompanying drawings, wherein.

Figure 1:
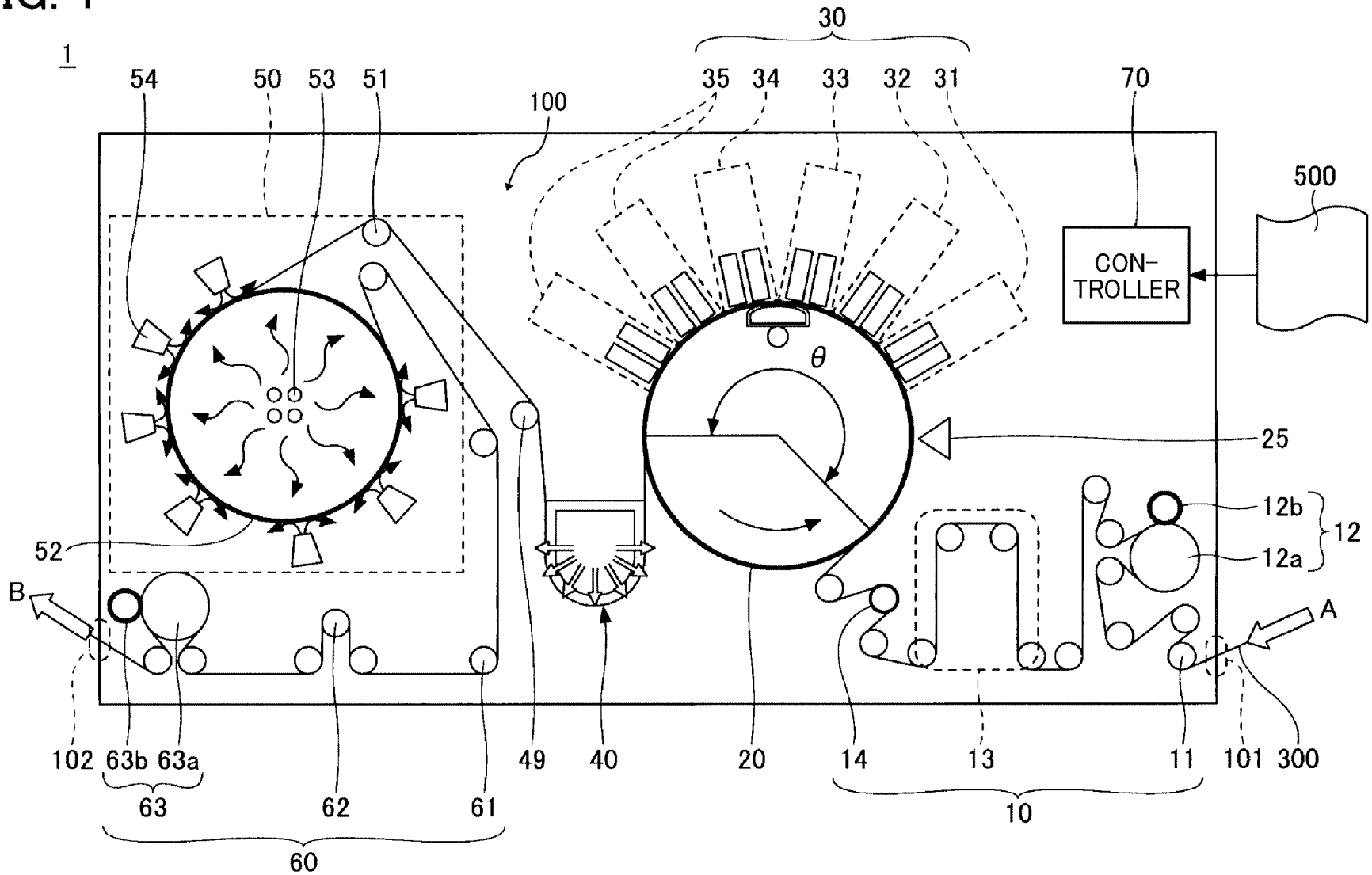
FIG. 1 is a schematic view of an example of an image forming apparatus according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Below, embodiments of the present disclosure are described with reference to accompanying drawings. In each of the drawings, the same reference codes are allocated to components or portions having the same configuration and redundant descriptions of the same components may be omitted.

First Embodiment

FIG. 1 is a schematic diagram of an example of an image forming apparatus according to a first embodiment of the present disclosure. As illustrated in FIG. 1, an image forming apparatus 1 according to the present embodiment includes, as main components, a feed conveyor 10, a platen drum 20, an image forming unit 30, an air turn bar system 40, a drier 50, an ejection conveyor 60, and a controller 70. Note that a section including the platen drum 20, the air turn bar system 40, and the drier 50 is referred to as a conveying device 100 in the first embodiment. In some embodiments, the conveying device 100 may include the feed conveyor 10 (first conveyor) and the ejection conveyor 60 (second conveyor).

Figure 2:
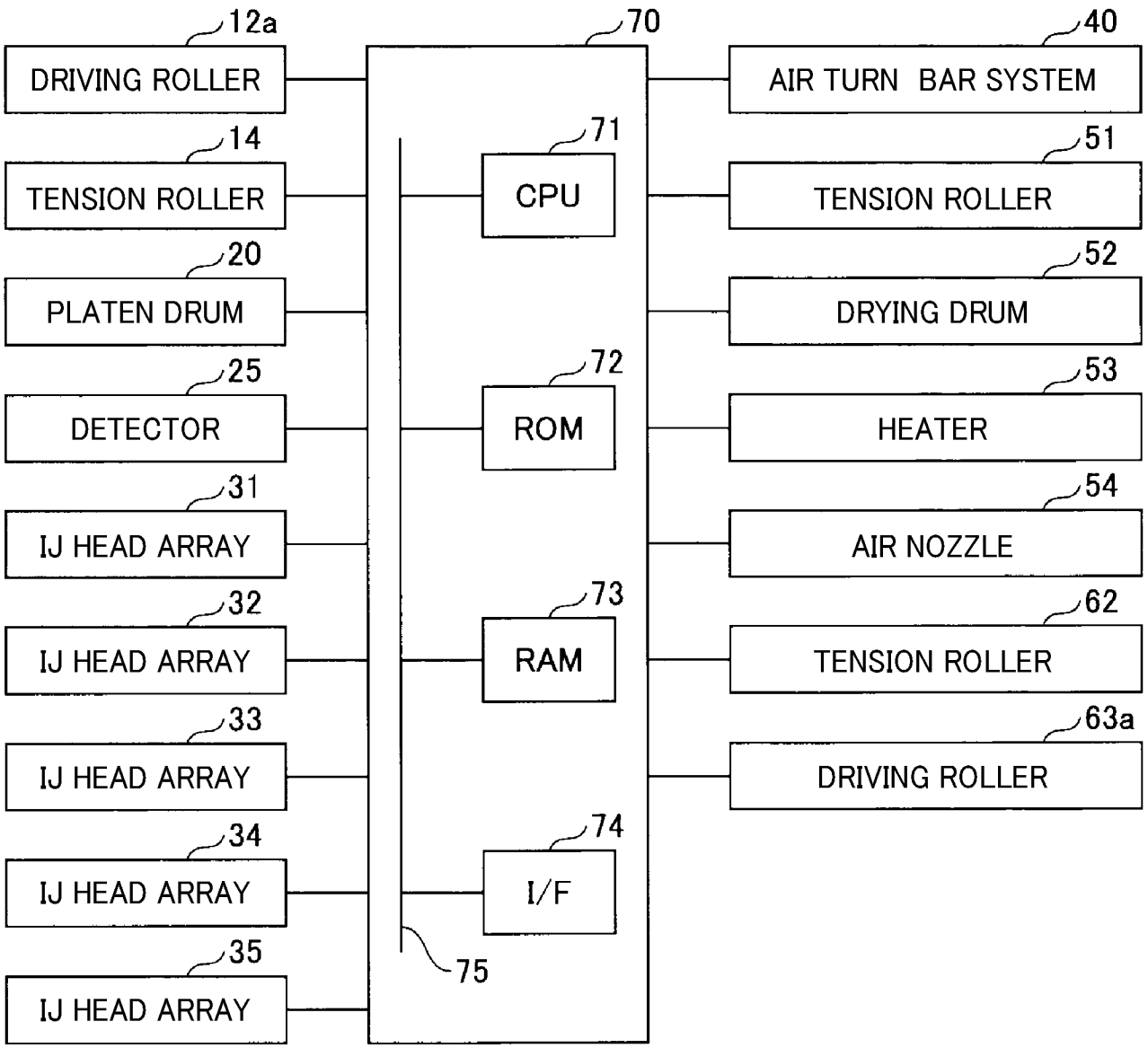
FIG. 2 is a diagram illustrating a hardware configuration of a controller.

FIG. 2 is a diagram of an example of a hardware configuration of the controller. As illustrated in FIG. 2, the controller 70 includes a central processing unit (CPU) 71, a read only memory (ROM) 72, a random access memory (RAM) 73, an interface (I/F) 74, and a bus line 75 as main components. The CPU 71, the ROM 72, the RAM 73, and the I/F 74 are mutually connected via the bus line 75. The controller 70 is connected to various controlled objects, various sensors, and the like.

The CPU 71 controls functions of the controller 70. The ROM 72 as a storage device stores programs executed by the CPU 71 to control functions of the controller 70 and various information. The RAM 73 as a storage device is used as a work area or the like of the CPU 71. The RAM 73 can temporarily store predetermined information. The I/F 74 is an interface for connecting with other devices and the like, and is connected to, for example, an external network.

Note that a part or the whole of the controller 70 may be constituted by hardware. Examples of the hardware include an application specific integrated circuit (ASIC), a digital signal processor (DSP), and a field programmable gate array (FPGA).

Figure 3:
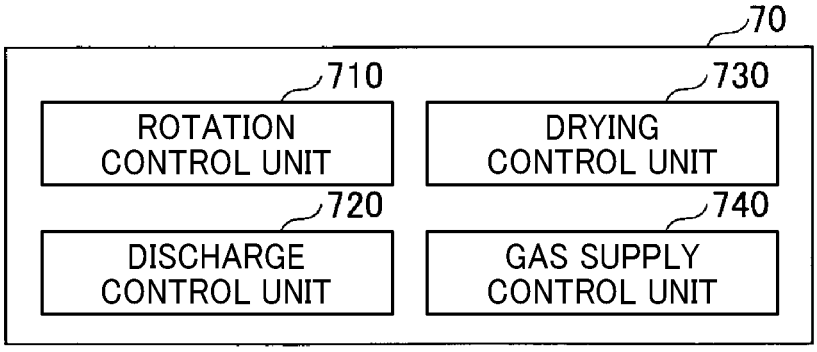
FIG. 3 is a diagram illustrating functional blocks of the controller.

FIG. 3 is a diagram of an example of functional blocks of the controller. As illustrated in FIG. 3, the controller 70 includes, for example, a rotation control unit 710, a discharge control unit 720, a drying control unit 730, and a gas supply control unit 740 as main functional blocks. Specific functions of each function block are described later in the descriptions of the drawings. Note that the controller 70 may have other functional blocks as necessary.

With reference back to FIG. 1, the image forming apparatus 1 includes an introduction port 101 and an exit port 102. The image forming apparatus 1 introduces a web-shaped recording medium 300, which is unwound from an unwinding device disposed outside the image forming apparatus 1 in a direction indicated by arrow A (hereinafter, direction A) in FIG. 1, from the introduction port 101. After forming an image on a surface (one side) of the web-shaped recording medium 300, the image forming apparatus 1 sends out the web-shaped recording medium 300 from the exit port 102 in a direction indicated by arrow B (hereinafter, direction B) in FIG. 1. The web-shaped recording medium 300 is, for example, continuous paper. However, the material of the web-shaped recording medium 300 is not limited to paper.

The web-shaped recording medium 300 sent out in the direction B is delivered to a subsequent processing apparatus disposed outside the image forming apparatus 1. Examples of the subsequent processing apparatus include a turn bar that inverts the front and back sides of the web-shaped recording medium 300 to form an image on the back surface (back side) of the web-shaped recording medium 300 on which an image has been formed on the front surface, a winding device to wind the web-shaped recording medium 300, on which the images have been formed, on a roll, and a post-processing device, such as a cutter or a laminator.

The web-shaped recording medium 300 introduced from the introduction port 101 in the direction A passes, for example, the feed conveyor 10 including a plurality of conveyance idler rollers 11, paired conveyance drive rollers 12, an edge position control (EPC) device 13, and a tension roller 14, and is wound around the platen drum 20 and conveyed by the platen drum 20.

The paired conveyance drive rollers 12 include, for example, a driving roller 12*a* and a pinch roller 12*b*. The rotation control unit 710 of the controller 70 controls a driving source to drive the driving roller 12*a* and rotates the driving roller 12*a* at a predetermined rotation speed. Thus, the web-shaped recording medium 300 is conveyed. The EPC device 13 is a device to adjust the position of the web-shaped recording medium 300 to a specified position with respect to the width direction of the web-shaped recording medium 300. The tension roller 14 includes a pressure detector, such as a load cell, in a bearing portion, and detects the tension of the web-shaped recording medium 300.

The platen drum 20 is a rotator that winds the web-shaped recording medium 300 around a predetermined region on the outer peripheral surface of the platen drum 20 with an image formation surface of the web-shaped recording medium 300, on which an image is formed, facing outward, and conveys the web-shaped recording medium while rotating. More specifically, the rotation control unit 710 of the controller 70 controls a driving source for driving the platen drum 20 and rotates the platen drum 20 at a predetermined rotation speed. The tension of the web-shaped recording medium 300 caused by the rotation of the platen drum 20 is detected by the tension roller 14 and input to the controller 70. The rotation control unit 710 of the controller 70 controls the rotation speed of the paired conveyance drive rollers 12 so that the tension detected by the tension roller 14 reaches a preset value. Thus, the web-shaped recording medium 300 is conveyed while maintaining a predetermined tension.

The image forming unit 30 is disposed above the platen drum 20 in the vertical direction and opposite an outer peripheral surface of the platen drum 20. The image forming unit 30 forms an image on the web-shaped recording medium 300. The image forming unit 30 can form an image with, for example, aqueous ink. The aqueous ink is an ink using water as a solvent, for example, an aqueous dye ink or an aqueous pigment ink.

The image forming unit 30 includes, for example, a plurality of inkjet recording head arrays (IJ head arrays) arranged in a conveyance direction of the web-shaped recording medium 300 along the outer periphery of the platen drum 20. Each IJ head array includes, for example, a plurality of IJ heads arranged side by side in a direction orthogonal to the conveyance direction of the web-shaped recording medium 300.

In FIG. 1, the image forming unit 30 discharges an IJ head array 31 to discharge black (K) ink, an IJ head array 32 to discharge cyan (C) ink, and an IJ head array 33 to discharge magenta (M) ink, an IJ head array 34 to discharge yellow (Y) ink, and an IJ head array 35 to discharge special color ink.

The image forming unit 30 is controlled by the controller 70. A discharge control unit 720 of the controller 70 allocates nozzles to be discharged to each of the IJ heads constituting the IJ head arrays 31 to 35 according to print data 500 received from the outside of the image forming apparatus 1 and controls discharge timing of each IJ head.

The platen drum 20 is provided with a detector 25 to detect the movement amount of a drum surface (outer peripheral surface) of the platen drum 20. A detection signal of the detector 25 is input to the controller 70. The discharge control unit 720 of the controller 70 detects the correlation between the discharge timing of each of the IJ heads constituting the IJ head arrays 31 to 35 and the movement amount of the platen drum 20, based on the detection signal of the detector 25. Thus, the discharge control unit 720 can correct the discharge timing in accordance with the conveyance amount of the web-shaped recording medium 300.

Figure 4A:
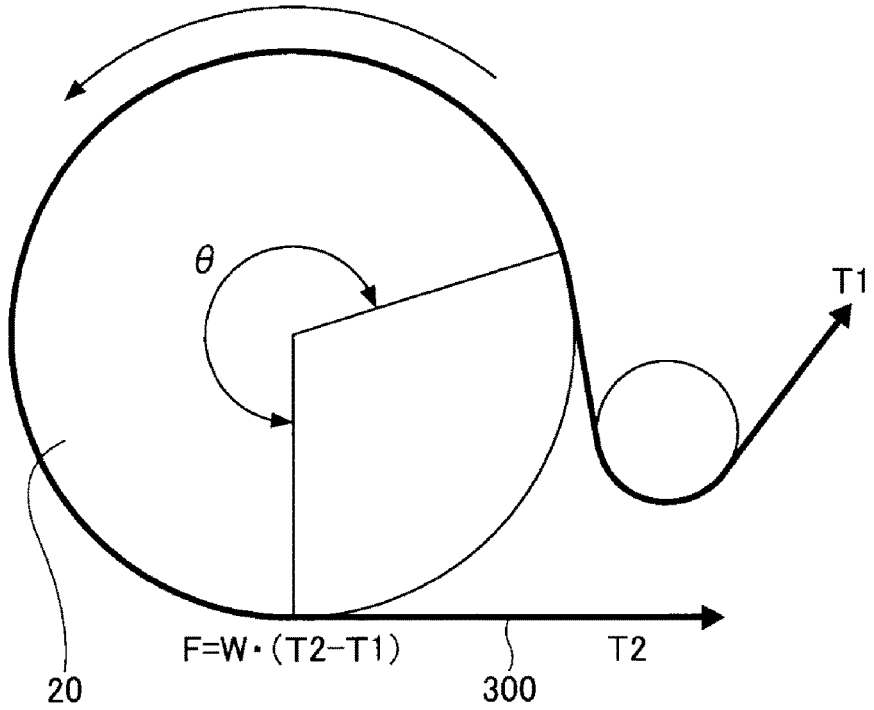
FIG. 4A is an illustration of relationship between winding angle θ and conveying force F.
Figure 4B:
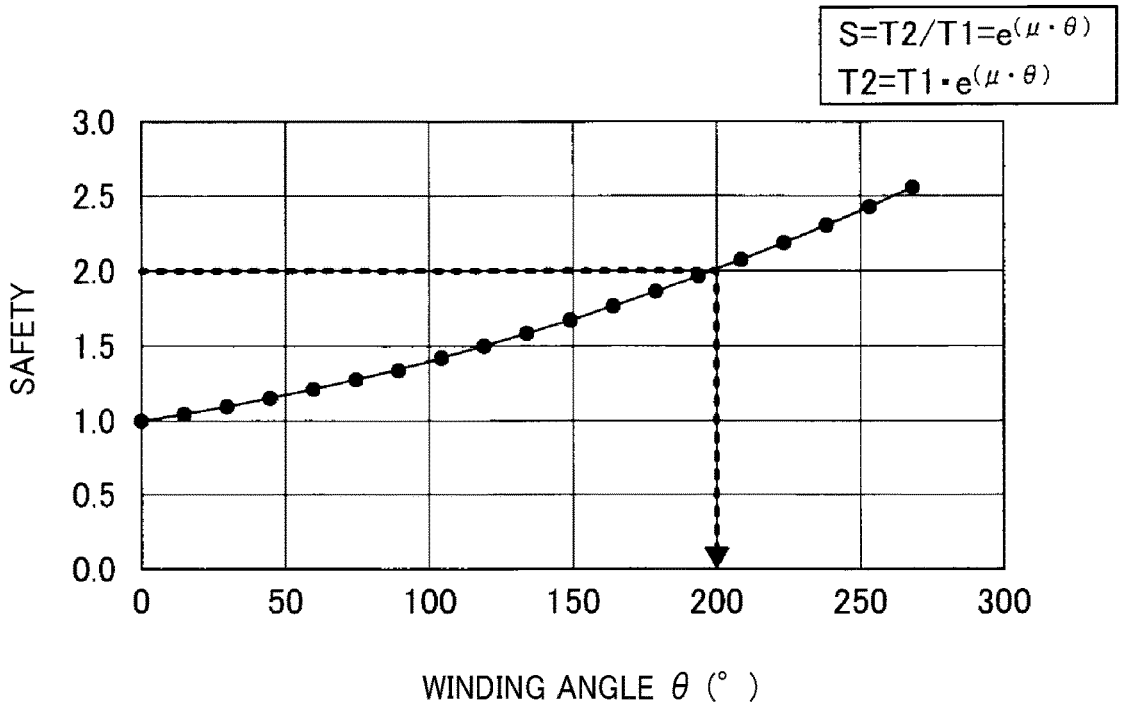
FIG. 4B is a graph illustrating an example of the relationship between the winding angle θ and the conveying force.

FIG. 4A is an illustration of the relationship between the winding angle θ and the conveying force F. FIG. 4B is a graph illustrating an example of the relationship between the winding angle θ and the conveying force F in conveyance of the web-shaped recording medium 300 that is wound around the platen drum 20 at a tension T1. T1 represents a tension on the tension roller 14 side, and T2 is a tension on the air turn bar system 40 side.

Assuming that the width of the web-shaped recording medium 300 is W and the coefficient of static friction between the web-shaped recording medium 300 and the platen drum 20 is μ, the relationship between T1 and T2 and the conveying force F are expressed by the following Equation 1 and Equation 2, respectively.

Equation 1

$$T2/T1=e^{(\mu\cdot\theta)} \quad (1)$$

Equation 2

$$F=W\cdot T1\{e^{(\mu\cdot\theta)}-1\} \quad (2)$$

To accurately reflect the corrected discharge timing, which has been corrected by the discharge control unit 720 of the controller 70, on printing, the web-shaped recording medium 300 is conveyed while maintaining close contact with or a micro slip state against the platen drum 20. Therefore, preferably, the conveying force F is set to be sufficiently greater than the tension T1.

The graph of FIG. 4 represents the relationship between the winding angle θ and the safety of the conveying force F against the tension. The static friction coefficient μ is empirically about 0.3, but in consideration of variation, μ is set to be 0.2. The graph of FIG. 4 represents that, when the winding angle θ is 200 degrees or more, the safety is twice or more than when the winding angle θ is zero degree. In other words, FIG. 4 illustrates that, if the web-shaped recording medium 300 is wound around the platen drum 20 by 200 degrees or more, a conveying force F that can withstand an external force of twice or more than the tension without slipping can be obtained.

Accordingly, by designing the winding angle θ of the web-shaped recording medium 300 to the platen drum 20 to be 200 degrees or more, the web-shaped recording medium can be conveyed with a sufficient margin for slipping.

Further, with the above-described configuration, the web-shaped recording medium 300 is tightly wound around the outer peripheral surface of the platen drum 20 and conveyed, thus preventing fluttering of the web-shaped recording medium 300. Accordingly, since the IJ head arrays 31 to 35 constituting the image forming unit 30 do not contact the web-shaped recording medium 300, the IJ head arrays 31 to 35 can be disposed proximate to the platen drum 20 to the extent that vibration of the platen drum 20 does not cause the contact of the web-shaped recording medium 300 with the IJ head arrays 31 to 35.

Since each of the IJ heads constituting the IJ head arrays 31 to 35 varies in discharge angle between nozzles, reducing the distance between each IJ head and the platen drum 20 can reduce the variation of landing positions of ink droplets, thus allowing printing with higher image qualities.

Returning to FIG. 1, the web-shaped recording medium 300 passing through the platen drum 20 is conveyed substantially downward from the platen drum 20. The web-shaped recording medium 300 is wound around an outer peripheral surface (for example, an outer peripheral surface having an arc-shaped region in side view) of an air turn bar 41 constituting the air turn bar system 40, and the conveyance direction of the web-shaped recording medium 300 is changed substantially upward. The web-shaped recording medium 300, the conveying direction of which has been changed substantially upward, is conveyed to the drier 50 through a conveyance idler roller 49. Details of the air turn bar system 40 is described later.

The drier 50 is disposed downstream from the platen drum 20 and the air turn bar 41 in the conveyance direction of the web-shaped recording medium 300. The drier 50 dries the image formed on the web-shaped recording medium 300 by the image forming unit 30, and conveys the web-shaped recording medium 300. The drier 50 dries, for example, undried aqueous ink in the image formed by the image forming unit 30. The drier 50 is disposed at a position not overlapping with the platen drum 20 in a plan view and includes a tension roller 51, a drying drum 52, a heater 53, and a plurality of air nozzles 54.

Note that the term "plan view" means a view from the normal direction of a horizontal plane on which the image forming apparatus 1 is disposed in a normally usable state.

The tension roller 51 includes a pressure detector, such as a load cell, in a bearing portion, and detects the tension of the web-shaped recording medium 300 extended between the platen drum 20 and the drying drum 52. The tension roller 51 is a typical example of the tension detector according to an embodiment of the present disclosure.

The drying drum 52 winds the web-shaped recording medium 300 around a predetermined region on an outer peripheral surface of the drying drum 52 with an image formation surface of the web-shaped recording medium 300, on which the image is formed, facing outward, and conveys the web-shaped recording medium 300 as the drying drum 52 rotates. The drying drum 52 is a typical example of a second rotator according to an embodiment of the present disclosure.

The rotation control unit 710 of the controller 70 controls the rotation speed of the drying drum 52. For example, the rotation control unit 710 controls a driving source to drive the drying drum 52, and rotates the drying drum 52 at a predetermined rotation speed. The tension of the web-shaped recording medium 300 caused by the rotation of the drying drum 52 is detected by the tension roller 51 and input to the controller 70. The rotation control unit 710 of the controller 70 controls the rotation speed of the drying drum 52 so that the tension detected by the tension roller 51 becomes a preset value. Accordingly, the web-shaped recording medium 300 can be conveyed while maintaining the tension of the web-shaped recording medium 300 between the platen drum 20 and the drier 50 at a predetermined value.

The tension detector of the tension roller 51 is not limited to the load cell. The tension of the web-shaped recording medium 300 may be detected, for example, by swingably supporting the tension roller 51, pressing the tension roller 51 with an elastic member in a tensioning direction of the web-shaped recording medium 300, and measuring the pressure of the tension roller 51 to detect the tension of the web-shaped recording medium 300.

A heater 53 made of, for example, a halogen lamp or the like is disposed inside the drying drum 52. The air nozzles 54 are arranged to surround the periphery of the drying drum 52. The heating amount of the heater 53 and the blowing amount of the air nozzles 54 are controlled by the drying control unit 730 of the controller 70. The web-shaped recording medium 300 wound around the drying drum 52 is heated from the rear side (back side) of the image formation surface by the heater 53 and air (at normal temperature) or hot air is blown to the image formation surface (front side) by the air nozzles 54. Thus, the ink discharged onto the web-shaped recording medium 300 can be dried.

Note that, from viewpoints from the physical properties of ink and the productivity required for the apparatus, drying may be promoted by installing a technique of drying the drier 50 with thermal radiation of an infrared heater or the like to the drier 50.

When the ink is dried by the drier 50, a contactable film is formed on a surface of the ink. After drying, the web-shaped recording medium 300 passes through the ejection conveyor 60 including, for example, a plurality of conveyance idler rollers 61, a tension roller 62, and paired conveyance driving rollers 63. The web-shaped recording medium 300 is ejected in the direction indicated by arrow B from the exit port 102, and is delivered to a post-processing device or the like in the subsequent stage.

The paired conveyance driving rollers 63 include, for example, a driving roller 63*a* and a pinch roller 63*b*. The rotation control unit 710 of the controller 70 controls a driving source to drive the driving roller 63*a* to rotate the driving roller 63*a* at a predetermined rotation speed. The tension of the web-shaped recording medium 300 caused by the rotation of the driving roller 63*a* is detected by the tension roller 62 and input to the controller 70. The rotation control unit 710 of the controller 70 controls the rotation speed of the driving roller 63*a* so that the tension detected by the tension roller 62 becomes a preset value. Thus, the web-shaped recording medium 300 is conveyed while maintaining a predetermined tension.

Figure 5A:
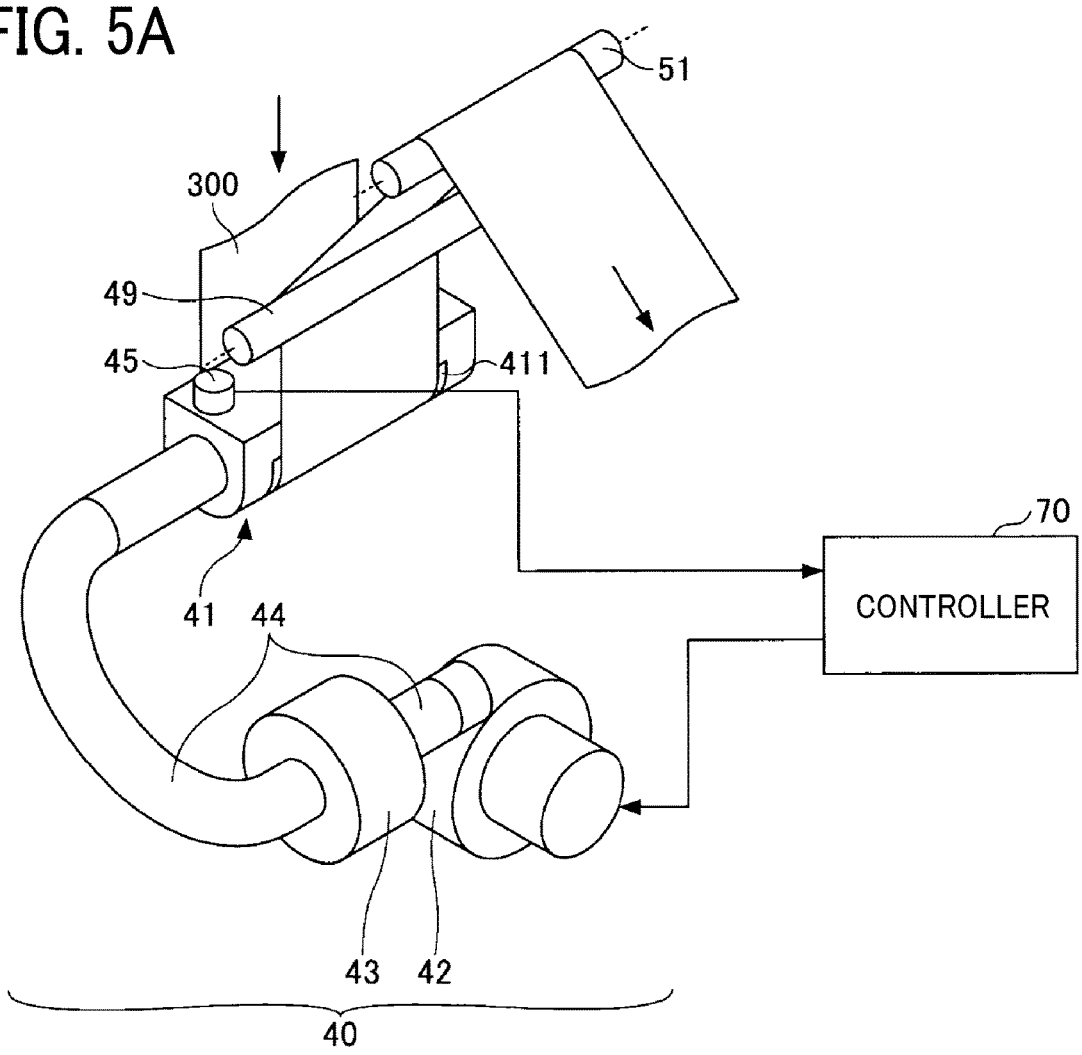
FIG. 5A is a schematic view of a configuration example of an air turn bar system according to the first embodiment.
Figure 5B:
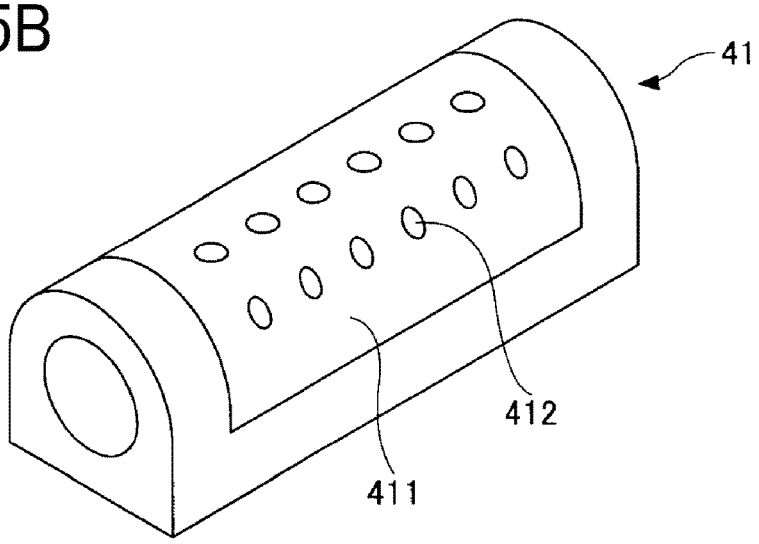
FIG. 5B is an enlarged upside-down view of an air turn bar of the air turn bar system illustrated in FIG. 5A.

Here, the air turn bar system 40 is described in detail. FIGS. 5A and 5B are schematic diagrams of a configuration example of the air turn bar system according to the first embodiment. FIG. 5A is a illustration of an example of the entire configuration of the air turn bar system. FIG. 5B is an enlarged upside-down view of the air turn bar 41.

As illustrated in FIG. 5A, the air turn bar system 40 includes the air turn bar 41, a blower 42, a filter 43, a gas flow path 44, and a pressure sensor 45.

The air turn bar 41 is disposed on a conveyance path of the web-shaped recording medium 300 between the platen drum 20 and the drier 50, and can change the conveyance direction of the web-shaped recording medium 300, for example, by 180 degrees. The air turn bar 41 is a typical example of a conveyance direction changer according to an embodiment of the present disclosure.

The blower 42 is connected to the air turn bar 41 via the gas flow path 44, and can supply gas to the air turn bar 41. The supply amount of gas supplied from the blower 42 is controlled by the gas supply control unit 740 of the controller 70. The blower 42 is a typical example of the gas supplier according to an embodiment of the present disclosure.

The filter 43 is inserted into the gas flow path 44 between the air turn bar 41 and the blower 42, and can remove foreign matters and the like contained in the gas supplied from the blower 42. The gas flow path 44 is a flow path of the gas supplied from the blower 42. Here, the gas is, for example, air.

The pressure sensor 45 is disposed near the air turn bar 41 and can detect the internal pressure of the air turn bar 41. The detected value of the internal pressure of the air turn bar 41 detected by the pressure sensor 45 is input to the controller 70. As the pressure sensor 45, for example, a sensor having a piezoresistance can be used. The pressure sensor 45 is a typical example of a pressure detector according to an embodiment of the present disclosure.

An outer peripheral surface 411 of the air turn bar 41 around which the web-shaped recording medium 300 is wound has an opposed region opposed to the image formation surface of the web-shaped recording medium on which an image is formed. The opposed region may be a part or the whole of the outer peripheral surface 411. The opposed region includes a plurality of air blowing holes 412, which are openings for blowing gas toward the image formation surface of the web-shaped recording medium 300 on which an image is formed. The shape and arrangement pattern of the air blowing holes 412 are not particularly limited and can be appropriately determined as necessary.

The gas supplied from the blower 42 is introduced into the air turn bar 41 via the filter 43 and blown out from the plurality of air blowing holes 412 of the outer peripheral surface 411. The blown gas flows into between the image formation surface of the web-shaped recording medium 300 wound around the outer peripheral surface 411 of the air turn bar 41 and the outer peripheral surface 411 of the air turn bar 41, brings the web-shaped recording medium 300 into contact with the air turn bar 41, and floats the web-shaped recording medium 300 from the outer peripheral surface 411 of the air turn bar 41.

In the air turn bar system 40, to reliably float and convey the web-shaped recording medium 300, a gas having a pressure sufficient to float the web-shaped recording medium 300 is supplied to the air turn bar 41.

In the present embodiment, the pressure sensor 45 to measure the internal pressure of the air turn bar 41 is disposed near the air turn bar 41. The gas supply control unit 740 of the controller 70 compares a detection result of the internal pressure of the air turn bar 41 by the pressure sensor 45 with a preset numerical value, and controls the amount of gas supplied by the blower 42 according to the comparison result.

Figure 6:
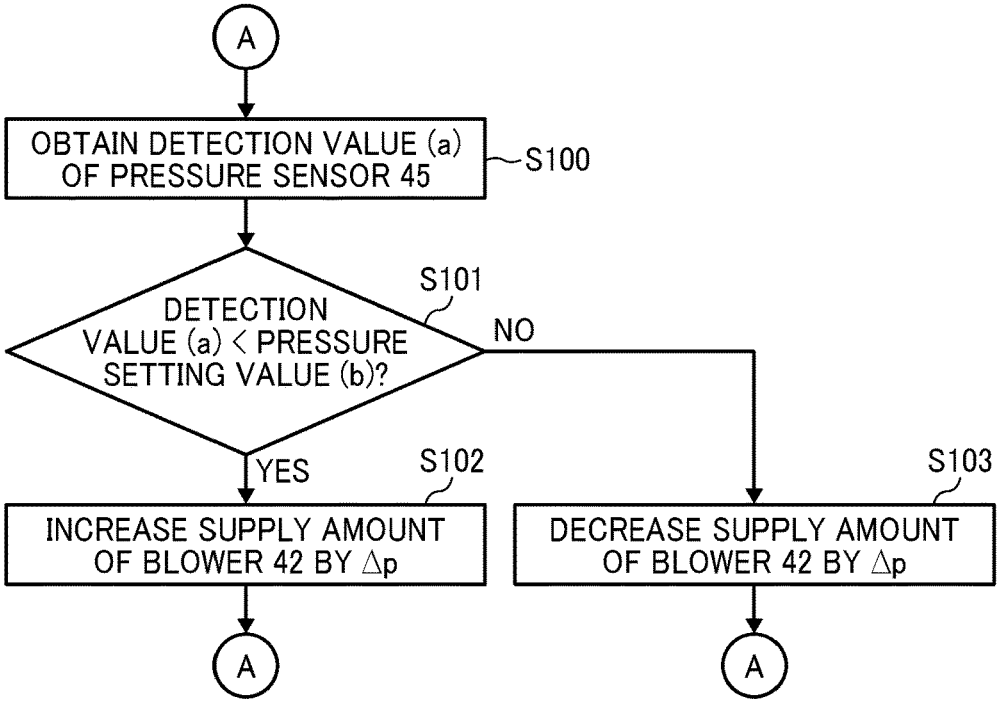
FIG. 6 is a flowchart of an example of control of the supply amount of gas supplied by a blower.

For example, as illustrated in step S100 of FIG. 6, the gas supply control unit 740 obtains a detection result (a detection value "a" of the pressure sensor 45) of the internal pressure of the air turn bar 41 by the pressure sensor 45.

Next, in step S101, the gas supply control unit 740 compares the detection value "a" of the pressure sensor 45 with a preset numerical value (a pressure setting value "b"), and determines whether the detection value "a" of the pressure sensor 45 is smaller than the pressure setting value "b". Note that the pressure setting value "b" is stored in, for example, the RAM 73, and the gas supply control unit 740 can read the pressure setting value "b" from the RAM 73 as necessary.

If the gas supply control unit 740 determines in step S101 that the detection value "a" is smaller than the pressure setting value "b" of the pressure sensor 45 (YES in step S101), the process proceeds to step S102. The gas supply control unit 740 increases the supply amount of gas of the blower 42 by Δp.

When the gas supply control unit 740 determines in step S101 that the detection value "a" of the pressure sensor 45 is equal to or greater than the pressure setting value "b" (NO in step S101), the process proceeds to step S103 and the gas supply control unit 740 decreases the supply amount of gas of the blower 42 by Δp. The processing from step S100 to step S103 is repeatedly executed. The gas supply control unit 740 can interrupt or stop the processing at desired timing.

Performing the control illustrated in FIG. 6 allows the gas having a pressure sufficient to float the web-shaped recording medium 300 to be stably supplied to the air turn bar 41, thus allowing the web-shaped recording medium 300 to be reliably floated and conveyed.

Note that the above-described process is an example of a method of stabilizing the internal pressure of the air turn bar 41, and the internal pressure of the air turn bar 41 may be stabilized by another method. For example, a plurality of pressure check points may be set in the air turn bar 41, and the gas supply control unit 740 may measure the internal pressure of the air turn bar 41 at the respective pressure check points. Alternatively, a method may be employed that controls the supply amount of the gas supplied by the blower 42 such that the gas supply control unit 740 matches the measured value of each pressure check point with a predetermined pressure setting value.

In the image forming apparatus 1, the air turn bar system 40 allows the web-shaped recording medium 300 conveyed from the platen drum 20 to be conveyed while floating from the outer peripheral surface 411 of the air turn bar 41. Accordingly, an image formed with undried ink on the image formation surface of the web-shaped recording medium 300 is introduced to the drier 50 without being disturbed. The undried ink on the image formation surface of the web-shaped recording medium 300 is dried by the drier 50, and a contactable film is formed on the surface of the ink.

Note that, in FIG. 1, the configuration is illustrated in which the detection mechanism disposed on the tension roller 51 detects the tension of the web-shaped recording medium 300 between the platen drum 20 and the drier 50 to control the tension. However, in the configuration of FIGS. 5A and 5B, the internal pressure of the air turn bar 41 can be detected. Therefore, instead of controlling the tension of the web-shaped recording medium 300 according to the tension detection result of the tension roller 51 as illustrated in FIG. 1, for example, the following control may be performed.

That is, the rotation control unit 710 of the controller 70 may detect the tension of the web-shaped recording medium 300 extended between the platen drum 20 and the drying drum 52, based on the detection result of the internal pressure of the air turn bar 41 by the pressure sensor 45, and control the rotational speed of the drying drum 52 based on the detected tension. For example, the rotation control unit 710 may detect the tension of the web-shaped recording medium 300 extended between the platen drum 20 and the drying drum 52, based on the correlation between the internal pressure of the air turn bar 41 and the tension of the web-shaped recording medium 300 wound around the outer peripheral surface 411 of the air turn bar 41, and control the rotational speed of the drying drum 52 based on the detected tension.

Figure 7:
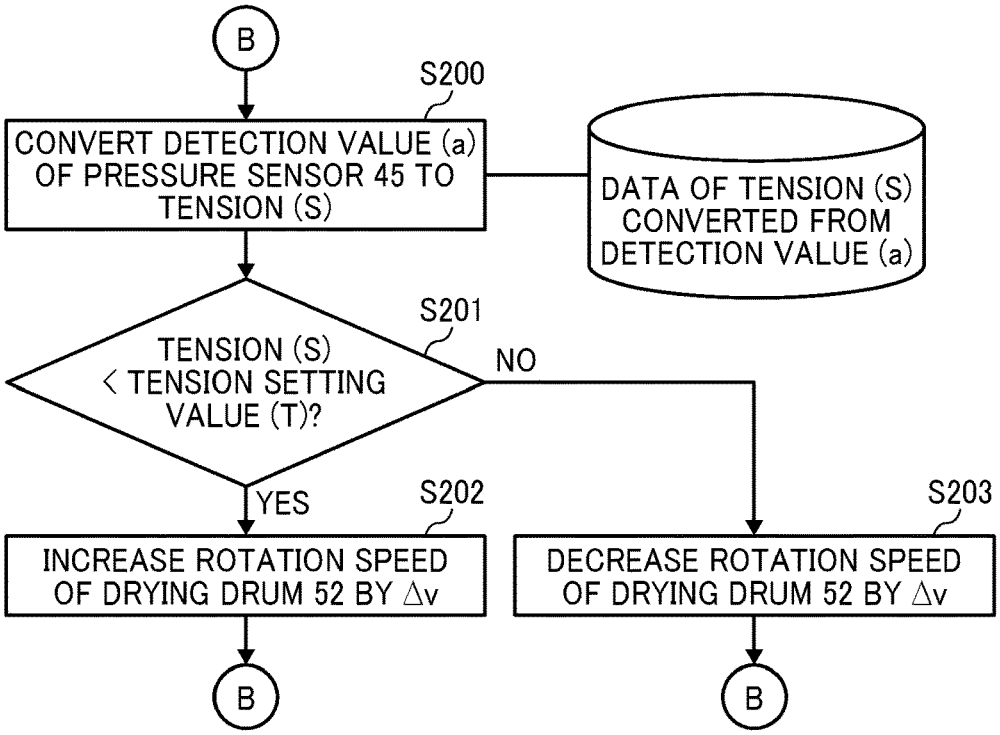
FIG. 7 is a flowchart of an example of control of the tension of a web-shaped recording medium.

More specifically, as illustrated in step S200 of FIG. 7, the rotation control unit 710 obtains a detection result of the internal pressure of the air turn bar 41 by the pressure sensor 45 (a detection value "a" of the pressure sensor 45) and converts the detection value "a" to a tension S. The conversion can be carried out, for example, based on conversion data of the detection value "a" and the tension S stored in the RAM 73.

Next, in step S201, the rotation control unit 710 compares the tension S with a preset numerical value (tension setting value T), and determines whether the tension S is smaller than the tension setting value T. Note that the tension setting value T is stored in, for example, the RAM 73, and the rotation control unit 710 can read the tension setting value T from the RAM 73 as necessary.

If the rotation control unit 710 determines in step S201 that the tension S is smaller than the tension setting value T (YES in step S201), the process proceeds to step S202. The rotation control unit 710 increases the rotation speed of the drying drum 52 by Δv.

If the rotation control unit 710 determines in step S201 that the tension S is equal to or greater than the tension setting value T (NO in step S201), the process proceeds to step S203. The rotation control unit 710 decreases the rotation speed of the drying drum 52 by Δv. The processing from step S200 to step S203 is repeatedly executed. The rotation control unit 710 can interrupt or stop the processing at desired timing.

As illustrated in FIG. 7, the detected value of the internal pressure of the air turn bar 41 is converted into a tension and compared with a preset numerical value, and the rotational speed of the drying drum 52 (conveyance speed of the web-shaped recording medium 300) is adjusted, thus allowing tension control. Accordingly, the tension control can be performed by an inexpensive configuration in which a pressure detection mechanism, such as a load cell, arranged on the tension roller 51 is omitted.

The process illustrated in FIG. 7 is effective to handle a homogeneous web recording medium 300 since the internal pressure varies with the air permeability of the web-shaped recording medium 300 wound around the air turn bar 41.

Likewise, since the air turn bar 41 is a system in which the web-shaped recording medium 300 is floated by air pressure, the floating amount varies with the air permeability of a material constituting the web-shaped recording medium 300. When the floating amount is excessively low due to a material having an extremely high air permeability, an undried ink image may contact the outer peripheral surface 411 of the air turn bar 41 and disturb the image. In addition, ink attached to the outer peripheral surface 411 may stain the surface of the subsequent web-shaped recording medium 300. Alternatively, a material having a low air permeability may cause an excessively large floating amount, thus causing meandering due to fluttering of the web-shaped recording medium 300. Therefore, the floating amount of the web-shaped recording medium 300 is preferably controlled to an appropriate range.

Figure 8:
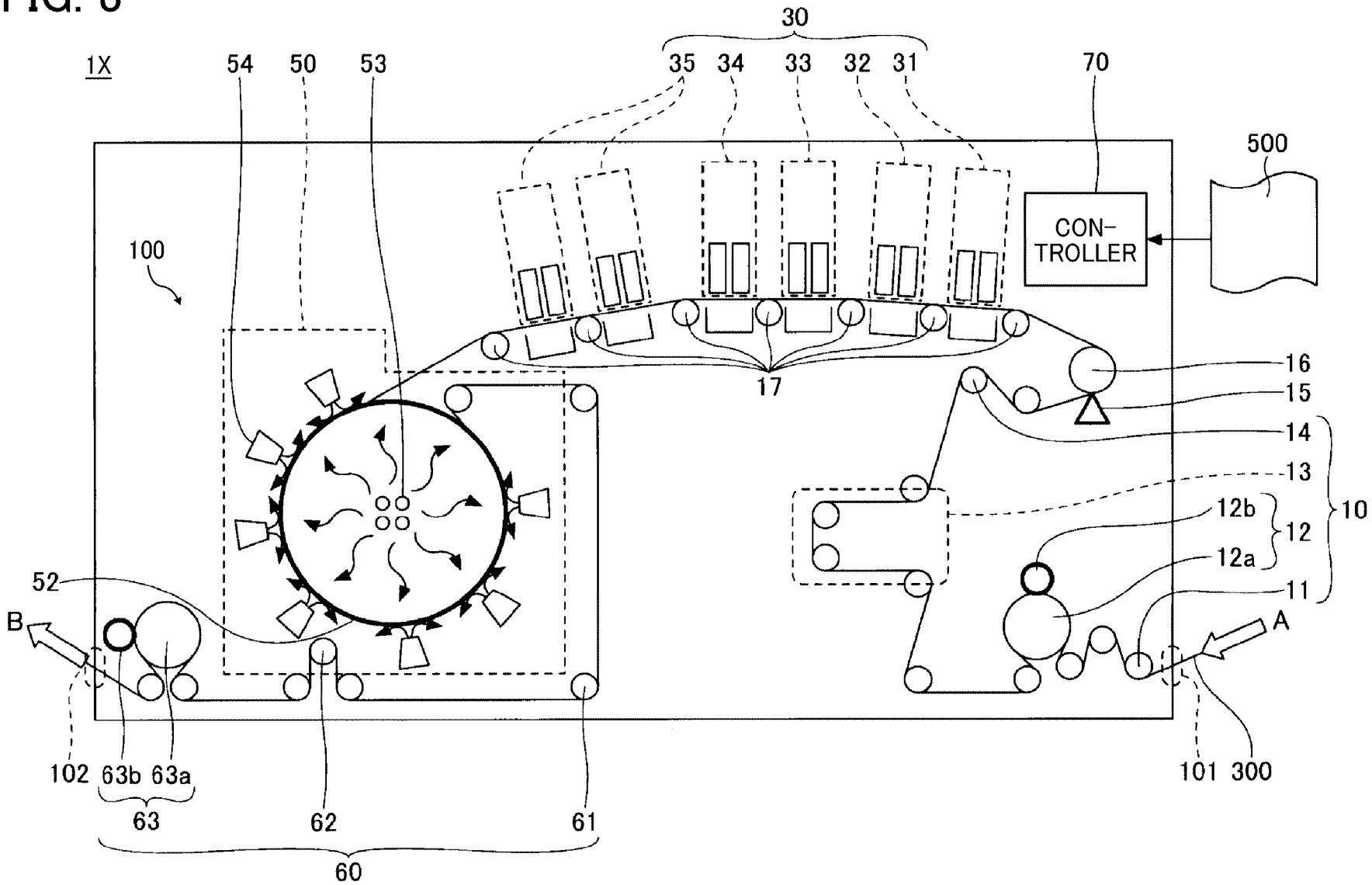
FIG. 8 is a schematic view of an example of an image forming apparatus according to Comparative Example 1.

Here, a comparative example is described. FIG. 8 is a schematic view of an example of an image forming apparatus according to Comparative Example 1. As illustrated in FIG. 8, an image forming apparatus 1X according to Comparative Example 1 includes web support rollers 17 including seven rollers to bridge the web-shaped recording medium 300. The image forming unit 30 is disposed above the web support rollers 17.

A length measuring roller 16 with an encoder 15 is disposed upstream from the image forming unit 30 in the conveyance direction of the web-shaped recording medium 300. Based on a detection signal of the encoder 15, the discharge timing is corrected according to the conveyance amount of the web-shaped recording medium 300, and an image is formed on the web-shaped recording medium 300.

In FIG. 8, the positional relationship between the web-shaped recording medium 300 and the image forming unit 30 is maintained only by the tension of the web-shaped recording medium 300 on the web support rollers 17. Accordingly, in the web-shaped recording medium 300, a parallelism error between the web support rollers 17 and fluttering or meandering due to the influence of the deflection occurs.

If fluttering occurs, the distance between each IJ head of the image forming unit 30 and the web-shaped recording medium 300 varies, thus causing an error in landing position of ink droplets in the conveyance direction. If meandering occurs, an error occurs in landing position of ink droplets in the width direction of the web-shaped recording medium 300. Furthermore, if the web-shaped recording medium 300 contacts the nozzle surface of the IJ head, print dot missing occurs due to nozzle clogging. Therefore, the distance between each IJ head and the recording medium is set in consideration of fluttering of the web-shaped recording medium 300, which may become a factor of deterioration of landing position accuracy.

Setting high tension of the web-shaped recording medium 300 can reduce fluttering and meandering. However, since too high tension cause a harmful effect, the restrictions on the use of the web-shaped recording medium 300 may occur if conditions cannot be satisfied. For example, if the tension is extremely increased with a paper medium, depending on the printing coverage of ink on the upstream side, the elastic modulus may decrease due to penetration of ink. Elongation may occur in the printing medium, and an error in landing position of the ink may occur due to lack of the conveyance amount.

In the case of oriented polypropylene (OPP) having a thickness of 20 μm, which is a soft packaging medium, when the tension exceeds 100 N/m, tension wrinkles are generated, thus causing an error in landing position. As described above, the system illustrated in FIG. 8 has a simple configuration. However, the restrictions on applicable recording media may increase.

Figure 9:
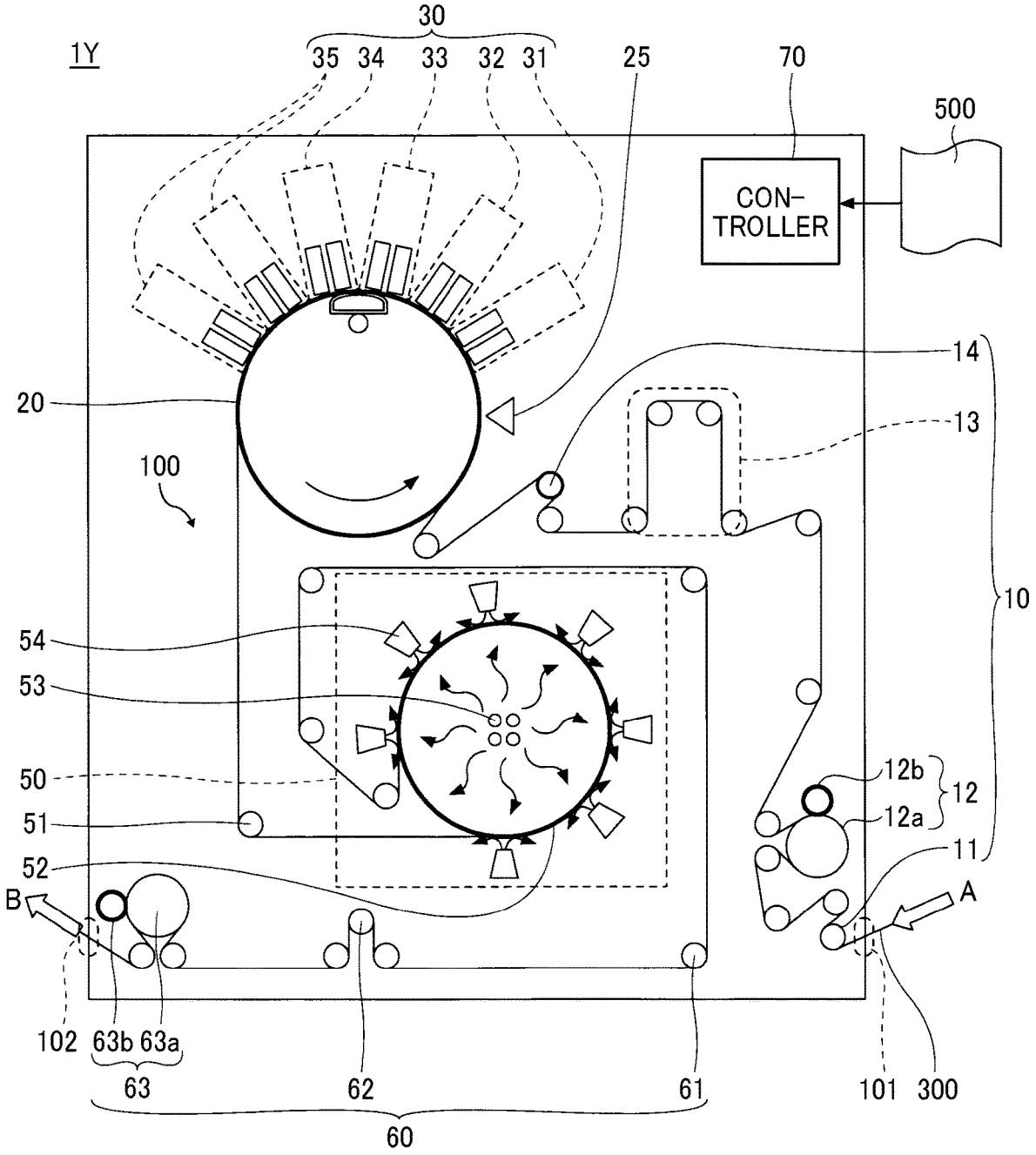
FIG. 9 is a schematic view of an example of an image forming apparatus according to Comparative Example 2.

FIG. 9 is a schematic view of an example of an image forming apparatus according to Comparative Example 2. As illustrated in FIG. 9, an image forming apparatus 1Y according to Comparative Example 2 includes the platen drum 20 as in FIG. 1. However, unlike FIG. 1, the image forming apparatus 1Y does not include the air turn bar system 40.

In the image forming apparatus 1Y, the web-shaped recording medium 300 printed by the image forming unit 30 is wound around the platen drum 20 at a winding angle at which sufficient conveying force is obtained, and conveyed. Below the platen drum 20, the web-shaped recording medium 300 is further conveyed downward from the platen drum 20 to the drier 50.

Since an undried ink image is formed on the image formation surface of the web-shaped recording medium 300 sent out of the platen drum 20, the web-shaped recording medium 300 cannot contact any conveying member until the ink is dried and a contactable film is formed on the surface of the ink.

Here, the IJ head arrays 31 to 35 of the image forming unit 30 are arranged along the outer periphery of the platen drum 20. The left end portion of the image forming unit 30 in the conveyance direction is located below a horizontal tangent passing an uppermost portion of the outer periphery of the platen drum 20.

Such a configuration hampers the drier 50 from being disposed on the left side of the platen drum 20 so as not to overlap with the platen drum 20 in plan view, and the web-shaped recording medium 300 from being horizontally conveyed from the platen drum 20 toward the drier 50. This is because the image formation surface of the web-shaped recording medium 300 would contact the left end portion of the image forming unit 30 in the conveyance direction.

Therefore, in FIG. 9, the drier 50 is disposed substantially below the platen drum 20 so that the image formation surface of the web-shaped recording medium 300 can be introduced into the drier 50 without contacting any portion.

Meanwhile, to dry the ink with the drier 50, the heating temperature and the heating time are set in accordance with the physical properties of ink and a printing medium. In a high-speed image forming apparatus, a long heating conveyance distance is set according to the conveyance speed in order to ensure the heating time, and the apparatus tends to be large.

Accordingly, in the configuration in which the drier 50 is disposed below the platen drum 20 as in the image forming apparatus 1Y, the height of the image forming apparatus would increase and may exceed 2 m. An increase in the height of the image forming apparatus would cause deterioration in operability of, e.g., loading of the web-shaped recording medium 300. For the transportation of the image forming apparatus, the height of a shipping container is generally about 2.5 m. Therefore, when the image forming apparatus exceeding 2 m is packed, the packed image forming apparatus is highly likely to exceed 2.5 m, which may hamper the image forming apparatus to be transported in assembled state.

Since the image forming apparatus exceeding the allowable height of the shipping container is disassembled and then transported, the image forming apparatus would be assembled on site after transportation, thus causing a failure of an increase in the installation time of the apparatus.

As an arrangement to avoid an increase in height of the apparatus, the web-shaped recording medium 300 may be drawn out in the right direction from the lowermost point of the platen drum 20 in the image forming apparatus 1Y. However, in such a case, to arrange the drier 50 on the right side of the platen drum 20, the length of the conveyance path of the feed conveying unit to the platen drum 20 and the length of the conveyance path from the drier 50 to the exit port 102 increase, thus causing a failure of increasing spoilage (broke, wasted paper) at the time of stopping printing startup.

On the other hand, the image forming apparatus 1 illustrated in FIG. 1 includes the air turn bar system 40. The air turn bar system 40 includes the air turn bar 41 and the blower 42 downstream from the platen drum 20. The air turn bar 41 has the plurality of air blowing holes 412 on the outer peripheral surface 411 around which the web-shaped recording medium 300 is wound. The blower 42 blows air to the air turn bar 41.

Accordingly, even if the image formation surface (printed surface) of the web-shaped recording medium 300 on which an image has been formed by the image forming unit 30 is conveyed facing the outer peripheral surface 411 of the air turn bar 41, a non-contact state of the image formation surface and the air turn bar 41 can be maintained. Thus, the conveyance direction can be turned along the outer peripheral surface 411 of the air turn bar 41 without disturbing the image formed on the image formation surface.

As a result, the platen drum 20 and the drier 50 can be disposed at positions not overlapping in a plan view, thus suppressing an increase in height and size of the apparatus while shortening the length of the conveyance path. In addition, since the length of the conveyance path length can be shortened, an image forming apparatus can be achieved that does not increase spoilage (broke, wasted paper).

In the image forming apparatus 1, the web-shaped recording medium 300 is wound around the platen drum 20, and the image forming unit 30 including, for example, the IJ head arrays 31 to 35 is arranged around the platen drum 20. Such a configuration can reduce the influence of variations due to the characteristics of the web-shaped recording medium 300 and stretching vibration during conveyance, and furthermore, the distance between the IJ head arrays 31 to 35 and the web-shaped recording medium 300 can be set small.

Accordingly, variations in landing of ink when forming an image on the web-shaped recording medium 300 are reduced, and high image quality of the image formed on the web-shaped recording medium 300 can be achieved. In addition, since there is no limitation on the type of web-shaped recording medium 300, complicated landing position adjustment for each web-shaped recording medium 300 can be obviated, thus allowing the accuracy of landing positions of ink to be stably maintained.

Variation of First Embodiment

As a variation of the first embodiment, an example is described in which an air turn bar system having a specification different from the specification of the first embodiment is used. Note that, in the variation of the first embodiment, descriptions of the same constituent parts as in the above-described embodiments may be omitted.

Figure 10:
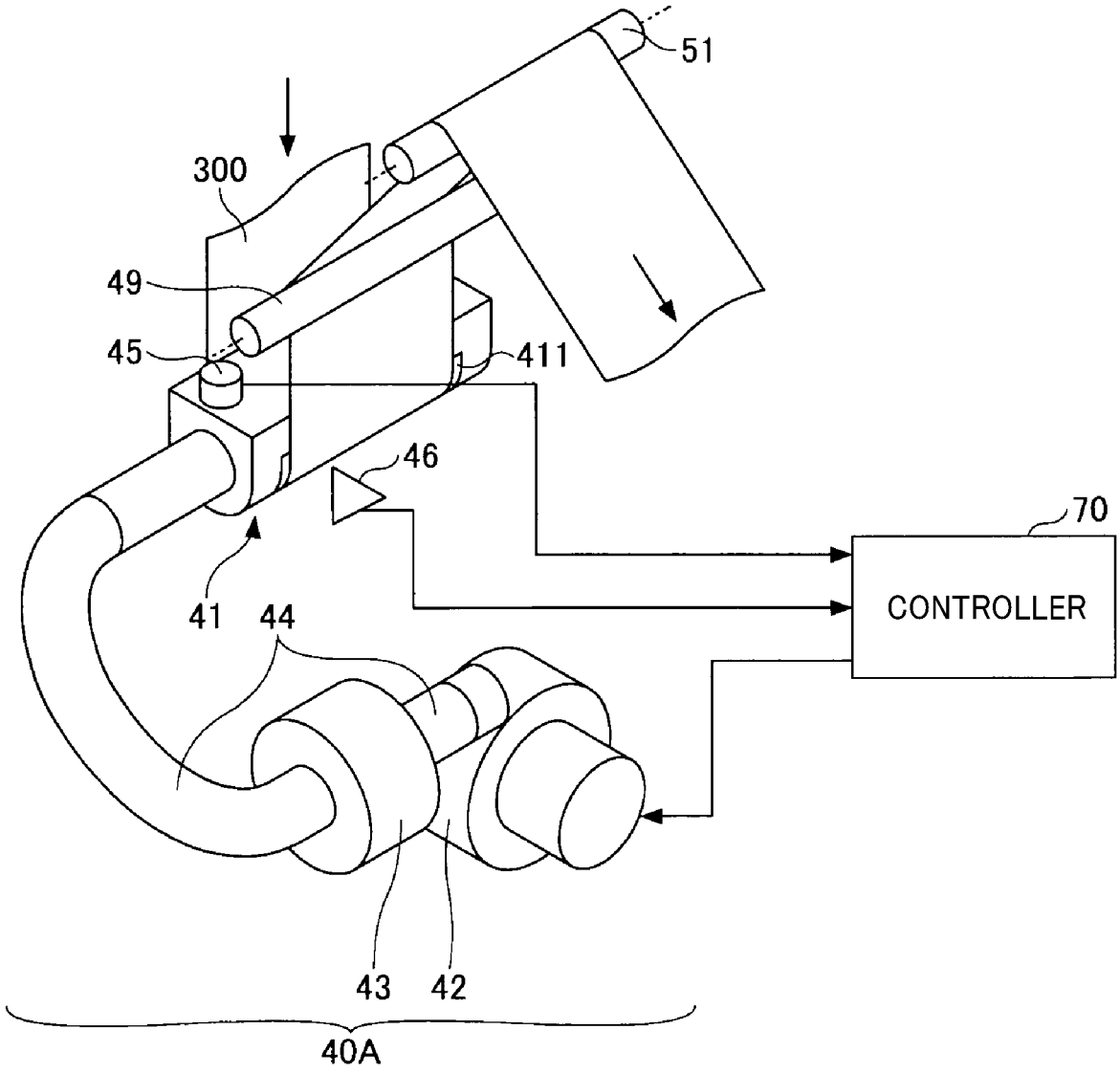
FIG. 10 is a schematic diagram of a configuration example of an air turn bar system according to a variation of the first embodiment.

FIG. 10 is a schematic diagram of a configuration example of an air turn bar system according to a variation of the first embodiment. As illustrated in FIG. 10, an air turn bar system 40A according to the variation of the first embodiment is different from the air turn bar system 40 (see FIG. 5A) in that a displacement sensor 46 is disposed opposite the back surface of the web-shaped recording medium 300 so as to sandwich the web-shaped recording medium 300 between the air turn bar system 40A and the outer peripheral surface 411 of the air turn bar 41).

The displacement sensor 46 is configured to be able to detect the floating amount of the web-shaped recording medium 300. As the displacement sensor 46, for example, an optical-type or an ultrasonic-type non-contact displacement sensor can be used. The displacement sensor 46 is a typical example of the floating amount detector according to an embodiment of the present disclosure.

The floating amount of the web-shaped recording medium 300 floated by the air turn bar 41 is likely to be smaller in the vicinity of a top of an arc of the outer peripheral surface 411 having an arc-shaped region in a side view of the outer peripheral surface 411 of the air turn bar 41 and end portions of the web-shaped recording medium 300 in the width direction of the web-shaped recording medium 300 (perpendicular to the conveyance direction) than other portions.

Therefore, although the displacement sensor 46 may be singular or plural, the displacement sensor 46 is preferably arranged in the vicinity of at least one of the top of the arc of the outer peripheral surface 411 of the air turn bar 41 and the end portions of the web-shaped recording medium 300 in the width direction of the web-shaped recording medium 300. Such a configuration can reliably prevent an undried ink image from contacting the outer peripheral surface 411 of the air turn bar 41 due to an insufficient floating amount of the web-shaped recording medium 300.

In the air turn bar system 40A, the gas supply control unit 740 of the controller 70 compares the floating amount of the web-shaped recording medium 300 detected by the displacement sensor 46 with a preset numerical value, and controls the supply amount of gas of the blower 42 based on the comparison result.

Figure 11:
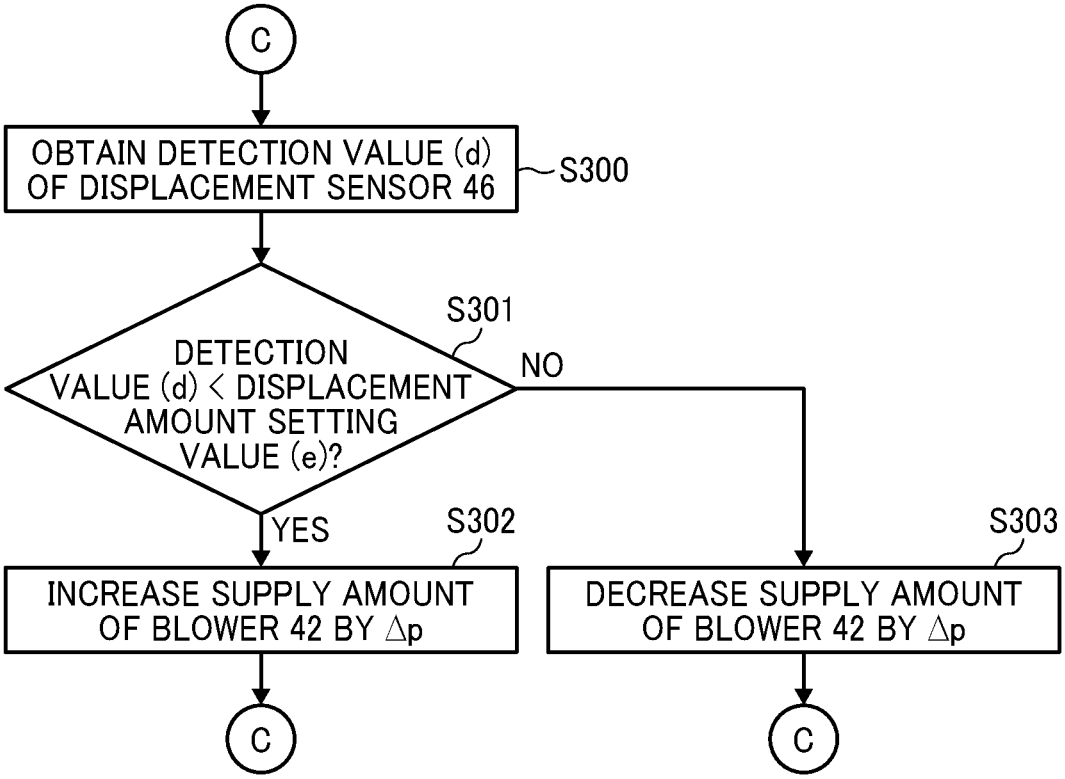
FIG. 11 is a flowchart of another example of control of the supply amount of gas supplied by the blower.

For example, as illustrated in step S300 in FIG. 11, the gas supply control unit 740 of the controller 70 obtains a detection result (a detected value "d" of the floating amount of the web-shaped recording medium 300) of the displacement sensor 46.

Next, in step S301, the gas supply control unit 740 compares the detection value "d" of the displacement sensor 46 with a preset numerical value (displacement amount setting value "e") and determines whether the detection value "d" of the displacement sensor 46 is smaller than the displacement amount setting value "e". Note that the displacement amount setting value "e" is stored in, for example, the RAM 73 and can be read out by the gas supply control unit 740 as needed.

If the gas supply control unit 740 determines in step S301 that the detection value "d" of the displacement sensor 46 is smaller than the displacement amount setting value "e" (YES in step S301), the process proceeds to step S302 and the gas supply control unit 740 increases the amount of gas to be supplied by the blower 42 by Δp.

If the gas supply control unit 740 determines in step S301 that the detection value "d" is equal to or greater than the displacement amount setting value "e" of the displacement sensor 46) (NO in step S301), the process proceeds to step S303 and the gas supply control unit 740 decreases the supply amount of gas to be supplied by the blower 42 by Δp. Although the processing from step S300 to step S303 is repeatedly executed, the gas supply control unit 740 can suspend or stop the processing at necessary timing.

The control illustrated in FIG. 11 allows the floating amount of the web-shaped recording medium 300 to be controlled within an appropriate range.

On the other hand, the floating amount of the web-shaped recording medium 300 also varies with the tension of the web-shaped recording medium 300. For example, when the tension of the web-shaped recording medium 300 is large, the floating amount decreases, and when the tension is small, the floating amount increases.

Hence, in addition to the control of the output of the blower 42 by the controller 70, the rotation speed of the drying drum 52 is controlled so that the tension detected by the tension roller 51 falls within an appropriate range, thus allowing the floating amount of more various types of media to be controlled by the air turn bar 41.

Figure 12A:
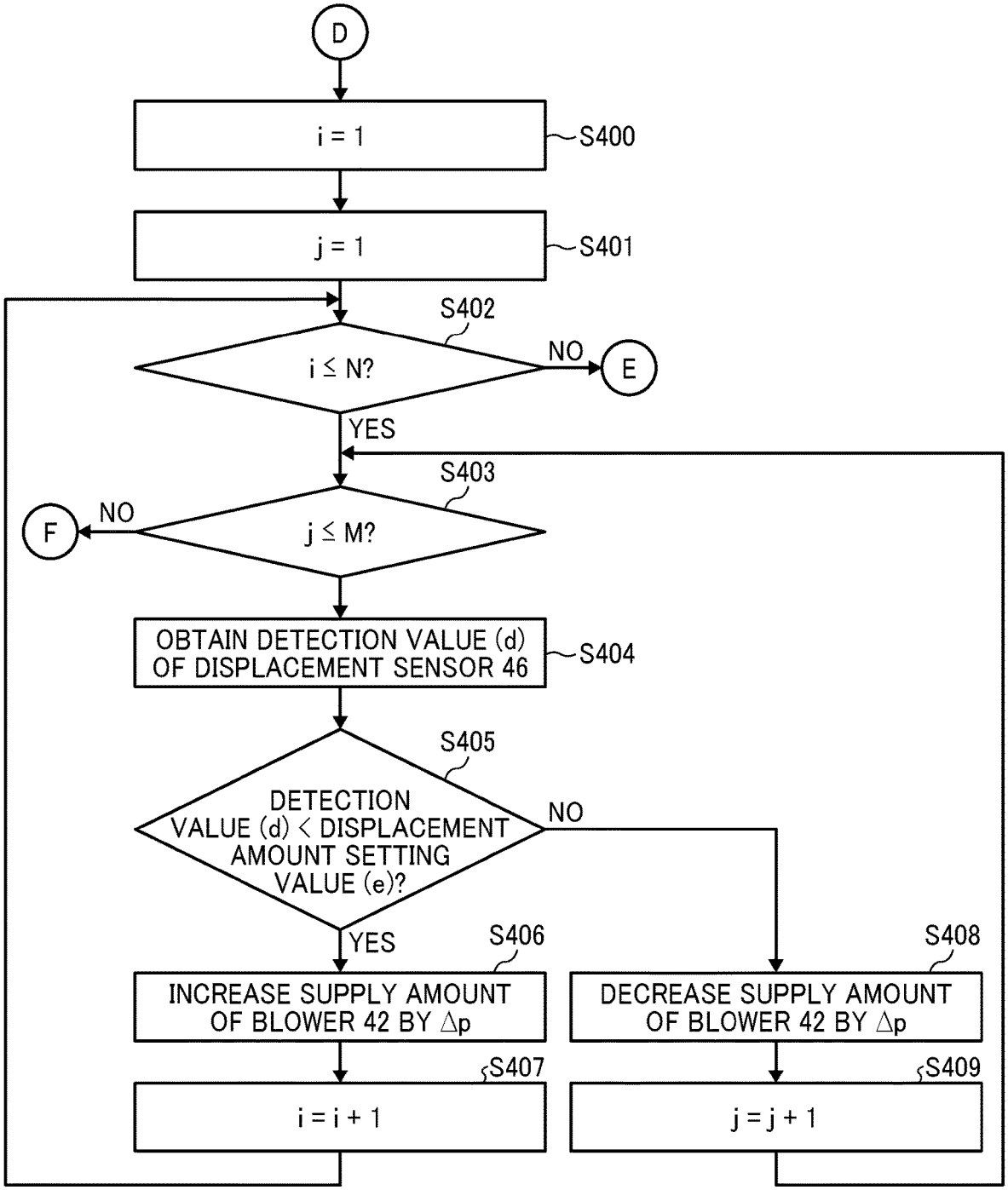
FIGS. 12A to 12C illustrate a flowchart of an example of control of the supply amount of gas supplied by the blower and the tension of the web-shaped recording medium.

Specifically, in step S400 of FIG. 12A, the gas supply control unit 740 of the controller 70 sets variable i to i=1. Next, in step S401, the gas supply control unit 740 sets variable j to j=1. Next, in step S402, the gas supply control unit 740 compares i with N and determines whether i is equal to or smaller than N. Here, N is the number of retries.

When the gas supply control unit 740 determines in step S402 that i is equal to or smaller than N (YES in S402), the process proceeds to step S403. In step S403, the gas supply control unit 740 compares j with M and determines whether j is equal to or smaller than M. Here, M is the number of retries.

If the gas supply control unit 740 determines in step S403 that j is equal to or smaller than M (YES in step S403), the process proceeds to step S404. In step S404, the gas supply control unit 740 of the controller 70 obtains whether the detection result of the displacement sensor 46 (the detection value "d" of the floating amount of the web-shaped recording medium 300).

Next, in step S405, the gas supply control unit 740 compares the detection value "d" of the displacement sensor 46 with a preset numerical value (displacement amount setting value "e"), and determines whether the detection value "d" of the displacement sensor 46 is smaller than the displacement amount setting value "e". Note that the displacement amount setting value "e" is stored in, for example, the RAM 73 and can be read out by the gas supply control unit 740 as needed.

If the gas supply control unit 740 determines in step S405 that the detection value "d" of the displacement sensor 46 is smaller than the displacement amount setting value "e" (YES in step S405), the process proceeds to step S406 and the gas supply control unit 740 increases the supply amount of gas to be supplied by the blower 42 by Δp. Then, in step S407, the gas supply control unit 740 sets i=i+1, proceeds to step S402, and repeats the same processing thereafter.

If the gas supply control unit 740 determines in step S405 that the detection value "d" of the displacement sensor 46 is equal to or greater than the displacement amount setting value "e" (NO in step S405), the process proceeds to step S408 and the gas supply control unit 740 decreases the supply amount of gas to be supplied by the blower 42 by Δp. Then, in step S409, the gas supply control unit 740 sets j=j+1, proceeds to step S403, and repeats the same processing thereafter.

Figure 12B:
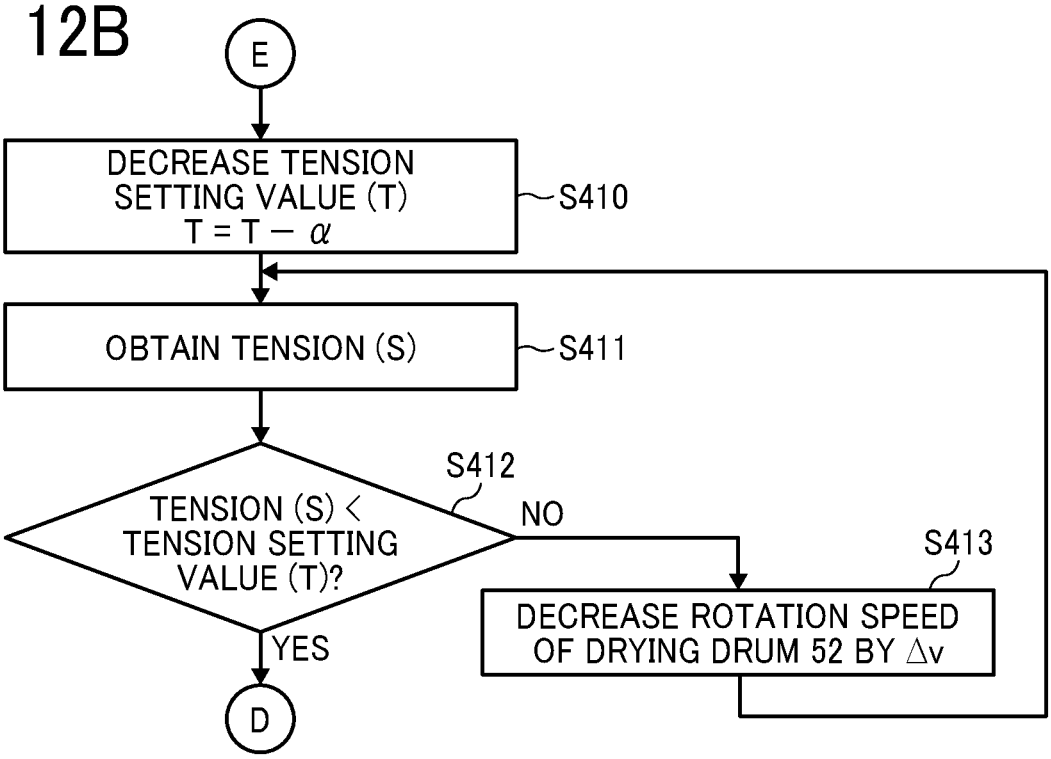

On the other hand, if the gas supply control unit 740 determines in step S402 that i is greater than N (NO in step S402), the process proceeds to step S410 of FIG. 12B and the rotation control unit 710 of the controller 70 lowers the tension setting value T to T−α. Here, α is a change amount of the tension that is appropriately set.

Next, in step S411, the rotation control unit 710 obtains the tension S detected by the tension roller 51. Next, in step S412, the rotation control unit 710 compares the tension S with the tension setting value T after the change in step S410, and determines whether the tension S is smaller than the tension setting value T.

If the rotation control unit 710 determines in step S412 that the tension S is smaller than the tension setting value T (YES in step S412), the process proceeds to step S400 and the rotation control unit 710 repeats the same processing thereafter.

If the rotation control unit 710 determines in step S412 that the tension S is equal to or greater than the tension setting value T (NO in step S412), the process proceeds to step S413 and the rotation control unit 710 decreases the rotation speed of the drying drum 52 by Δv. Then, the process proceeds to step S411, and the rotation control unit 710 repeats the same processing thereafter.

Figure 12C:
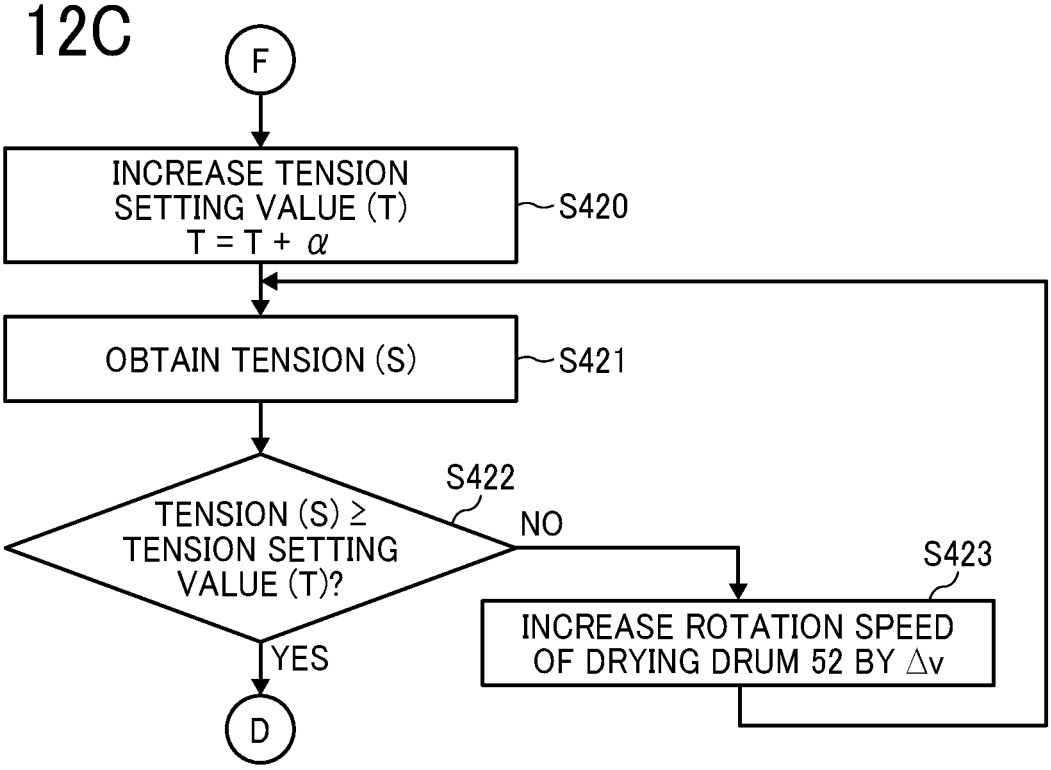

If the gas supply control unit 740 determines in step S403 that j is greater than M (NO in step S403), the process proceeds to step S420 of FIG. 12C and the rotation control unit 710 of the controller 70 increases the tension setting value T to T+α.

Next, in step S421, the rotation control unit 710 obtains the tension S detected by the tension roller 51. Next, in step S422, the rotation control unit 710 compares the tension S with the tension setting value T after the change in step S420, and determines whether the tension S is equal to or greater than the tension setting value T.

If the rotation control unit 710 determines in step S422 that the tension S is equal to or greater than the tension setting value T (YES in step S422), the process proceeds to step S400 and the rotation control unit 710 repeats the same processing thereafter.

If the rotation control unit 710 determines in step S422 that the tension S is smaller than the tension setting value T (NO in step S422), the process proceeds to step S423 and the rotation control unit 710 increases the rotational speed of the drying drum 52 by Δv. Then, the process proceeds to step S421, and the rotation control unit 710 repeats the same processing thereafter.

The control illustrated in FIGS. 12A to 12C allows the floating amount the floating amount of a wider variety of media to be controlled by the air turn bar. Thus, an image forming apparatus with high media compatibility can be provided.

Although some embodiments and variation have been described above, embodiments of the present disclosure are not limited to the above-described embodiments and variation. Various modifications and substitutions may be made to the above-described embodiments without departing from the scope described in the appended claims.

For example, in the above-described embodiments and variation, the image forming apparatus including the conveying device has been described. However, the conveying device according to an embodiment of the present disclosure can be widely applied to liquid discharge apparatuses including an image forming apparatus.

The term "liquid discharge apparatus" or "apparatus for discharging liquid" used herein is an apparatus including a liquid discharge head, which is a liquid discharge unit, or a liquid discharge device to discharge liquid by driving the liquid discharge unit. The liquid discharge apparatus may be, for example, an apparatus capable of discharging liquid to a material to which liquid can adhere and an apparatus to discharge liquid toward gas or into liquid.

The liquid discharge apparatus may include devices to feed, convey, and eject the material on which liquid can adhere. The liquid discharge apparatus may further include a pretreatment apparatus to coat a treatment liquid onto the material, and a post-treatment apparatus to coat a treatment liquid onto the material, onto which the liquid has been discharged.

The "liquid discharge apparatus" may be, for example, an image forming apparatus to form an image on a sheet by discharging ink, or a three-dimensional fabricating apparatus to discharge a fabrication liquid to a powder layer in which powder material is formed in layers, so as to form a three-dimensional fabrication object.

The liquid discharge apparatus is not limited to an apparatus to discharge liquid to visualize meaningful images, such as letters or figures. For example, the liquid discharge apparatus includes an apparatus to form meaningless images, such as meaningless patterns, or fabricate three-dimensional images.

The above-described term "material on which liquid can be adhered" represents a material on which liquid is at least temporarily adhered, a material on which liquid is adhered and fixed, or a material into which liquid is adhered to permeate. Examples of the "material on which liquid can be adhered" include recording media, such as paper sheet, recording paper, recording sheet of paper, film, and cloth, electronic component, such as electronic substrate and piezoelectric element, and media, such as powder layer, organ model, and testing cell. The "material on which liquid can be adhered" includes any material on which liquid is adhered, unless particularly limited.

Examples of the material on which liquid can be adhered include any materials on which liquid can be adhered even temporarily, such as paper, thread, fiber, fabric, leather, metal, plastic, glass, wood, and ceramic.

Examples of the liquid are, e.g., ink, treatment liquid, DNA sample, resist, pattern material, binder, fabrication liquid, or solution and dispersion liquid including amino acid, protein, or calcium.

The term "liquid discharge apparatus" may be an apparatus to relatively move a head and a medium on which liquid can be adhered. However, the liquid discharge apparatus is not limited to such an apparatus. For example, the liquid discharge apparatus may be a serial head apparatus that moves the liquid discharge head or a line head apparatus that does not move the liquid discharge head.

Examples of the "liquid discharge apparatus" further include a treatment liquid coating apparatus to discharge a treatment liquid to a sheet to coat the treatment liquid on the surface of the sheet to reform the sheet surface and an injection granulation apparatus in which a composition liquid including raw materials dispersed in a solution is injected through nozzles to granulate fine particles of the raw materials.

The "liquid discharge device" is an integrated unit including the liquid discharge head, such as an IJ head and functional parts or mechanisms, and is an assembly of parts relating to liquid discharge. For example, the "liquid discharge device" may be a combination of the liquid discharge head with at least one of the head tank, the carriage, the supply unit, the maintenance unit, and the main scan moving unit.

Here, examples of the integrated unit include a combination in which the liquid discharge head and a functional part(s) are secured to each other through, e.g., fastening, bonding, or engaging, and a combination in which one of the liquid discharge head and a functional part(s) is movably held by another. The liquid discharge head may be detachably attached to the functional part(s) or unit(s) each other.

In addition, "the liquid discharging head" has no specific limit to the pressure generator used in the liquid discharge head. The liquid discharge head may use, as the pressure generator, for example, a piezoelectric actuator (which may use a laminated piezoelectric element), a thermal actuator using an electrothermal transducer, such as a heating resistor, and an electrostatic actuator including a diaphragm and opposed electrodes.

The terms "image formation", "recording", "printing", "image printing", and "fabricating" used herein may be used synonymously with each other.

Each of the functions of the described embodiments may be implemented by one or more processing circuits. A processing circuit includes a programmed processor, as a processor includes circuitry. A processing circuit also includes devices such as an application specific integrated circuit (ASIC), a digital signal processor (DSP), a field programmable gate array (FPGA), and conventional circuit components arranged to perform the recited functions.

What is claimed is:

1. An image forming apparatus comprising:

a rotator to wind a web-shaped recording medium around a predetermined region of an outer peripheral surface of the rotator with one side of the web-shaped recording medium facing outward and convey the web-shaped recording medium with rotation of the rotator;

an image forming unit opposed to the outer peripheral surface of the rotator, to form an image on the one side of the web-shaped recording medium;

a drier disposed downstream from the rotator in a direction of conveyance of the web-shaped recording medium, to dry and convey the web-shaped recording medium; and a conveyance direction changer disposed on a conveyance path of the web-shaped recording medium between the rotator and the drier, the conveyance direction changer having an outer peripheral surface that includes an opposed region opposed to the one side of the web-shaped recording medium, the opposed region having openings to blow gas toward the one side of the web-shaped recording medium, and the rotator and the drier disposed at positions not overlapping with each other in a plan view.

2. The image forming apparatus according to claim 1, further comprising:

a first conveyor to convey the web-shaped recording medium to the rotator; and a second conveyor to convey the web-shaped recording medium dried by the drier to a downstream side from the drier in the direction of conveyance of the web-shaped recording medium.

3. The image forming apparatus according to claim 1, wherein the drier includes:

another rotator to wind the web-shaped recording medium around a predetermined region of an outer peripheral surface of said another rotator and convey the web-shaped recording medium with rotation of said another rotator;

a pressure detector to detect an internal pressure of the conveyance direction changer; and circuitry to control a rotation speed of said another rotator, wherein the circuitry detects a tension of the web-shaped recording medium based on the internal pressure detected by the pressure detector, compares the tension with a preset value, and controls the rotational speed of said another rotator based on a comparison result of the tension with the preset value.

4. The image forming apparatus according to claim 1, further comprising:

a pressure detector to detect an internal pressure of the conveyance direction changer;

a gas supplier to supply the gas to the conveyance direction changer; and circuitry to control a supply amount of the gas supplied by the gas supplier, wherein the circuitry compares the internal pressure detected by the pressure detector with a preset value and controls the supply amount of the gas supplied by the gas supplier, based on a comparison result of the internal pressure with the preset value.

5. The image forming apparatus according to claim 1, further comprising:

a gas supplier to supply the gas to the conveyance direction changer;

circuitry to control a supply amount of the gas supplied by the gas supplier; and a floating amount detector to detect a floating amount of the web-shaped recording medium from the opposed region, wherein the circuitry compares the floating amount detected by the floating amount detector with a preset value, and controls the supply amount of the gas supplied by the gas supplier, based on a comparison result of the floating amount with the preset value.

6. The image forming apparatus according to claim 5, wherein the drier includes:

another rotator to wind the web-shaped recording medium around a predetermined region of an outer peripheral surface of said another rotator and convey the web-shaped recording medium with rotation of said another rotator;

a tension detector to detect a tension of the web-shaped recording medium extended between the rotator and said another rotator; and circuitry to control a rotation speed of said another rotator, wherein the circuitry compares the tension detected by the tension detector with a preset value, and controls the rotational speed of said another rotator based on a comparison result of the tension with the preset value.

7. The image forming apparatus according to claim 5, wherein the outer peripheral surface of the conveyance direction changer has an arch-shaped region in a side view, and wherein the floating amount detector is disposed in a vicinity of at least one of a top of an arc of the arch-shaped region and end portions of the web-shaped recording medium in a direction perpendicular to the direction of conveyance of the web-shaped recording medium.

8. The image forming apparatus according to claim 1, wherein the image is formed of an aqueous ink, and the drier dries the aqueous ink.

9. The image forming apparatus according to claim 1, wherein the image forming unit includes a plurality of inkjet recording heads arranged side by side in a direction perpendicular to the direction of conveyance of the web-shaped recording medium.

10. The image forming apparatus according to claim 1:

wherein the image forming unit includes a liquid discharge unit opposed to the outer peripheral surface of the rotator, to discharge liquid onto the one side of the web-shaped recording medium.

11. A conveying device comprising:

a rotator to wind a web-shaped recording medium around a predetermined region of an outer peripheral surface of the rotator with one side of the web-shaped recording medium facing outward and convey the web-shaped recording medium with rotation of the rotator;

a drier disposed downstream from the rotator in a direction of conveyance of the web-shaped recording medium, to dry and convey the web-shaped recording medium; and a conveyance direction changer disposed on a conveyance path of the web-shaped recording medium between the rotator and the drier, the conveyance direction changer having an outer peripheral surface that includes an opposed region opposed to the one side of the web-shaped recording medium, the opposed region having openings to blow gas toward the one side of the web-shaped recording medium, the rotator and the drier disposed at positions not overlapping with each other in a plan view, and wherein the drier includes:

another rotator to wind the web-shaped recording medium around a predetermined region of an outer peripheral surface of said another rotator and convey the web-shaped recording medium with rotation of said another rotator;

a pressure detector to detect an internal pressure of the conveyance direction changer; and circuitry to control a rotation speed of said another rotator, wherein the circuitry detects a tension of the web-shaped recording medium based on the internal pressure detected by the pressure detector, compares the tension with a preset value, and controls the rotational speed of said another rotator based on a comparison result of the tension with the preset value.

12. A conveying device comprising:

a rotator to wind a web-shaped recording medium around a predetermined region of an outer peripheral surface of the rotator with one side of the web-shaped recording medium facing outward and convey the web-shaped recording medium with rotation of the rotator;

a drier disposed downstream from the rotator in a direction of conveyance of the web-shaped recording medium, to dry and convey the web-shaped recording medium; and a conveyance direction changer disposed on a conveyance path of the web-shaped recording medium between the rotator and the drier, the conveyance direction changer having an outer peripheral surface that includes an opposed region opposed to the one side of the web-shaped recording medium, the opposed region having openings to blow gas toward the one side of the web-shaped recording medium, the rotator and the drier disposed at positions not overlapping with each other in a plan view, and wherein the conveying device further comprises:

a gas supplier to supply the gas to the conveyance direction changer;

circuitry to control a supply amount of the gas supplied by the gas supplier; and a floating amount detector to detect a floating amount of the web-shaped recording medium from the opposed region, wherein the circuitry compares the floating amount detected by the floating amount detector with a preset value, and controls the supply amount of the gas supplied by the gas supplier, based on a comparison result of the floating amount with the preset value.

13. An image forming apparatus comprising:

a rotator to wind a recording medium around a predetermined region of an outer peripheral surface of the rotator with one side of the recording medium facing outward and convey the recording medium with rotation of the rotator;

an image forming unit opposed to the outer peripheral surface of the rotator, to form an image on the one side of the recording medium;

a drier disposed downstream from the rotator in a conveyance direction of the recording medium, to dry and convey the recording medium; and a conveyance direction changer to change the conveyance direction of the recording medium between the rotator and the drier, and to blow air toward one side of the recording medium, wherein the rotator and the drier are disposed at positions not overlapping with each other in a plan view.

14. The image forming apparatus according to claim 13, wherein a distance at which the recording medium is conveyed on the outer peripheral surface of the rotator in the conveyance direction is longer than a distance at which the recording medium is conveyed in the conveyance direction changer in the conveyance direction.

* * * * *